US010189029B2

(12) United States Patent
Khashan

(10) Patent No.: US 10,189,029 B2
(45) Date of Patent: Jan. 29, 2019

(54) MAGNETIC PARTICLE SEPARATOR

(71) Applicant: UNITED ARAB EMIRATES UNIVERSITY, Al Ain (AE)

(72) Inventor: Saud A. Khashan, Irbid (JO)

(73) Assignee: United Arab Emirates University, Ai-Ain (AE)

( * ) Notice: Subject to any disclaimer, the term of this patent is extended or adjusted under 35 U.S.C. 154(b) by 0 days.

(21) Appl. No.: 15/965,451

(22) Filed: Apr. 27, 2018

(65) Prior Publication Data

US 2018/0318844 A1 Nov. 8, 2018

Related U.S. Application Data

(63) Continuation-in-part of application No. 15/199,842, filed on Jun. 30, 2016, now Pat. No. 9,968,943.

(51) Int. Cl.
*B03C 1/033* (2006.01)

(52) U.S. Cl.
CPC ..... *B03C 1/033* (2013.01); *B03C 2201/18* (2013.01); *B03C 2201/20* (2013.01)

(58) Field of Classification Search
CPC ..... B03C 1/00; B03C 1/033; B03C 2201/18; B03C 2201/20

(Continued)

(56) References Cited

U.S. PATENT DOCUMENTS 4,663,029 A * 5/1987 Kelland ..... B03C 1/035 209/212

4,941,969 A * 7/1990 Schonert ..... B03C 1/035 209/212

(Continued)

FOREIGN PATENT DOCUMENTS

WO 2008147530 A1 12/2008

OTHER PUBLICATIONS

Khashan, Saud A. et al. "Numerical Analysis of Microfluidic Magnetic Bead Separation Utilizing an Integrated Array of Magnetic Elements Magnetized by a Homogenous Bias Field." a a 2 (2013): 5.

(Continued)

*Primary Examiner* — Terrell H Matthews
(74) *Attorney, Agent, or Firm* — Richard C. Litman

(57) ABSTRACT

The magnetic particle separator uses an induced magnetic field to separate magnetic particles held in solution by magnetophoresis. The magnetic particles may be, for example, inherently paramagnetic or superparamagnetic, may be magnetically tagged or the like. First and second magnetic particles initially flow along a longitudinal direction. An external magnetic field along a lateral direction, orthogonal (or near orthogonal) to the longitudinal direction, is applied to an externally magnetizable wire, which extends along a transverse direction orthogonal to both the longitudinal and lateral directions. The external magnetic field generates an induced magnetic field in the externally magnetizable wire, and the induced magnetic field generates repulsive magnetic force on the first and second magnetic particles. Due to differing magnetic susceptibility, size and/or mass between the first and second magnetic particles, they are separated by following separate paths generated by the respective magnetic forces thereon.

17 Claims, 10 Drawing Sheets

(58) Field of Classification Search
USPC ..... 209/39, 40, 212, 213, 215, 232
See application file for complete search history.

(56) References Cited

U.S. PATENT DOCUMENTS 5,655,665 A * 8/1997 Allen ..... B03C 1/035 209/223.1
6,432,630 B1 * 8/2002 Blankenstein ..... B01D 57/02 422/186
6,482,328 B1 * 11/2002 Davidson ..... B03C 1/005 209/215
7,892,427 B2 * 2/2011 Barbic ..... B01F 13/0059 209/213
8,071,054 B2 12/2011 Oh et al.
8,689,981 B2 4/2014 Stone et al.
8,834,698 B2 * 9/2014 Lau ..... B03C 5/005 204/547
8,950,590 B2 * 2/2015 Coffin ..... B01D 17/0217 209/713
9,090,663 B2 7/2015 Lin et al.
2004/0009614 A1 * 1/2004 Ahn ..... B01F 5/0403 436/526
2004/0018611 A1 1/2004 Ward et al.
2004/0021073 A1 * 2/2004 Barbic ..... B01F 13/0059 250/298
2005/0274650 A1 * 12/2005 Frazier ..... B03C 1/002 209/39
2009/0220932 A1 9/2009 Ingber et al.
2014/0065688 A1 3/2014 Murthy et al.

OTHER PUBLICATIONS

Kkhashan, Saud A. et al. "Coupled particle-fluid transport and magnetic separation in microfluidic systems with passive magnetic functionality." Journal of Physics D: Applied Physics 46.12 (2013): 125002.
Khashan, Saud A. et al. "Scalability analysis of magnetic bead separation in a microchannel with an array of soft magnetic elements in a uniform magnetic field." Separation and Purification Technology 125 (2014): 311-318.

* cited by examiner

MAGNETIC PARTICLE SEPARATOR

CROSS-REFERENCE TO RELATED APPLICATION

This application is a continuation-in-part of U.S. patent application Ser. No. 15/199,842, filed on Jun. 30, 2016.

BACKGROUND

1. Field

The disclosure of the present patent application relates to magnetic separation of microscopic particles, such as magnetically tagged cells and the like, and particularly to a magnetic particle separator using an induced magnetic field for separation of particles by magnetophoresis.

2. Description of the Related Art

The separation of microscopic particles has applications in a wide variety of different fields. For example, in medicine, the separation of a pure cell population from heterogeneous suspensions is a vital step that precedes analytical or diagnostic characterization of biological samples. The separation of key cell populations, such as circulating tumor cells and endothelial progenitor cells, can provide valuable insight into the prognosis and progression of certain diseases. Additionally, gaining this information in a minimally invasive fashion, such as through analysis of a blood sample, reduces the need for biopsies and invasive surgeries.

Present cell separation techniques may be broadly classified into two categories, including those based on size and density, and those based on affinity (i.e., chemical, electrical and/or magnetic affinity). Techniques that achieve separation based on size and density are generally unable to provide adequate resolution between cell populations known to be of similar size. Affinity-based approaches, such as cell adhesion chromatography and dielectrophoresis, are alternative methods to separate cell populations, but these techniques are still limited in the efficiency and purity of cell capture. Additionally, once target cells are isolated, recovery of viable cells for further application remains a challenge.

Another affinity-based technique is fluorescence activated cell sorting (FACS), in which antibodies tagged with fluorescent dyes are attached to cells in mixed suspensions via receptor-ligand binding. These cells are then sorted individually based on their fluorescence and light-scattering properties. Although this technique can provide highly pure cell populations, it requires expensive equipment and has limited throughput.

In recent years, there has been increasing interest in magnet-activated cell sorting (MACS), which allows target cell separation to be carried out in parallel, providing rapid separation of high-purity cell populations. However, operation of commercially-available MACS systems requires many processing steps, including several pre-processing and washing procedures, rendering it a very time-consuming, batch-wise procedure. To overcome some of these limitations, techniques based on continuous flow separation of magnetically tagged cells have been investigated. Present improvements on MACS, though, are still typically bulky and require large volumes of samples for operation. It should be understood that MACS and similar technologies also have application in a wide variety of fields. The separation of magnetic or magnetically labeled particles is commonly used in, for example, mineral processing, purification techniques, etc.

The most recent advancements of MACS technology have focused on miniaturization of the continuous flow analysis chambers to the micron scale. These microscale fluidic devices, or microfluidic channels, allow for the analysis of significantly smaller sample volumes while maintaining comparable purity of target cells within the collection suspension. Nonetheless, present microfluidic MACS technology is still limited in throughput in comparison to other continuous flow methods. It would be desirable to be able to further improve on microfluidic MACS technology to provide a more robust platform for the enumeration of a target cell population with high collection efficiencies, and particularly to be able to provide for continuous, multi-target, simultaneous and high throughput (i.e., scalable) magnetic separation techniques. Thus, a magnetic particle separator solving the aforementioned problems is desired.

SUMMARY

The magnetic particle separator uses an induced magnetic field to separate magnetic particles held in solution by magnetophoresis. The magnetic particles may be, for example, inherently paramagnetic or superparamagnetic, or may be magnetically tagged, or the like. The magnetic particle separator includes an elongated hollow channel, having opposed inlet and outlet ends, extending along a longitudinal axis. A mixture port is disposed at the inlet end of the hollow channel for injecting a mixture of first and second magnetic particles into the hollow channel. The target magnetic particles have separate and distinct properties with respect to each other, such as magnetic susceptibility, size, mass, or a combination thereof.

A buffer port may be disposed at the inlet end of the hollow channel for injecting a buffer solution into the hollow channel. The mixture of the first and second magnetic particles in the buffer solution flows through the hollow channel along the longitudinal direction toward the outlet end thereof. Preferably, the buffer port is formed from first and second branches positioned symmetrically about the mixture port, such that flow of the buffer solution from both of the first and second branches hydrodynamically focuses (although the flow may be inertially focused) flow of the mixture of the first and second magnetic particles in the buffer solution through the hollow channel.

First and second outlet channels are disposed at the outlet end of the hollow channel. Each of the first and second outlet channels is in fluid communication with each other, as well as with the outlet end of the hollow channel at a junction. Preferably, each of the first and second outlet channels has a substantially elliptical configuration, and the first and second outlet channels are positioned substantially concentrically such that the first outlet channel has a larger radius than the second outlet channel.

An externally magnetizable wire (such as, for example, a wire formed from a ferromagnetic material, nickel, permalloy or the like), extending along a transverse axis orthogonal (or close to orthogonal) to the longitudinal axis of the hollow channel, is positioned adjacent the junction internal to the first and second outlet channels. At least one magnetic source is provided for generating an external magnetic field along a lateral axis orthogonal to both the longitudinal axis and the transverse axis. The external magnetic field generates an induced magnetic field in and around the externally magnetizable wire, and this induced magnetic field applies a repulsive magnetic force to the target magnetic particles. Due to the separate and distinct properties of the first and second magnetic particles, and due to the difference in distance from the wire to the first and second outlet channels due to the unequal radii of the first and second outlet channels, the first and second magnetic particles are separated from one another to flow into the first and second outlet channels.

It is important to note that the magnetic particle separator primarily relies on the differential deflections experienced by the target magnetic particles by the repulsive magnetic force induced by the externally magnetizable wire (or a similar structure). It should be understood that although described above as separating first and second magnetic particles, the magnetic particle separator may be used for the manipulation and/or separation of one, two or more types of magnetic particles.

Further, it should be noted that the throughput of the magnetic particle separator is scalable; i.e., the throughput can be increased indefinitely by increasing the length of the externally magnetizable wire. The repulsive magnetic force generated by the magnetic field induced on the externally magnetizable wire (as opposed to direct magnetic interaction of the external magnetic field with the magnetic particles) allows the magnetic particle separator to deflect the magnetic particles into spatially addressable routes. The separated target particles may then be collected and/or immobilized for detection or a desired surface processing or counting.

It should be understood that the magnetic particle separator can be integrated with other down-stream processes and/or be integrated into controlled platforms. As an example, the magnetizable wire may be provided as part of a platform or on-chip system where the externally magnetizable wire is selectively positionable. The external magnetic field source could also be made to be selectively positionable. This could be accomplished via a micropositioning stage or the like, thus allowing the system to be pre-programmed according to a desired sorting protocol.

It should be further understood that the magnetic particle separator is not limited to the symmetric embodiment described above, and may have any suitable configuration, including separation into multiple arrayed or aligned receptacles for receiving corresponding separated particles.

Although an exemplary mixture of only two types of particles is described above, it should be understood that the mixture may contain any suitable number of different types of particles. In an alternative embodiment configured for a mixture of at least three types of particles, the first and second elliptical outlet channels of the previous embodiment are replaced by first, second and third outlet channels, each disposed at the outlet end of the elongated hollow channel. In this alternative embodiment, each of the first, second and third outlet channels has a substantially U-shaped configuration. The first, second and third outlet channels have, respectively, first, second and third pairs of branches, and first, second and third central portions.

The first, second and third outlet channels are in fluid communication with each other at a junction therebetween. The third central portion is positioned adjacent the outlet end of the elongated hollow channel. As in the previous embodiment, an externally magnetizable wire extends along a transverse axis orthogonal to the longitudinal axis, such that the externally magnetizable wire is positioned adjacent the first central portion of the first outlet channel. The second central portion of the second outlet channel is positioned between the first central portion of the first outlet channel and the third central portion of the third outlet channel, i.e., the third central portion of the third outlet channel is positioned closest to the outlet end of the elongated hollow channel and farthest from the externally magnetizable wire, the first central portion of the first outlet channel is positioned farthest from the outlet end of the elongated hollow channel and closest to the externally magnetizable wire, and the second central portion of the second outlet channel is positioned between the first central portion and the third central portion.

As in the previous embodiment, at least one magnetic source generates an external magnetic field along a lateral axis that is substantially orthogonal to the longitudinal axis and the transverse axis, such that the external magnetic field generates an induced magnetic field in the externally magnetizable wire. The induced magnetic field applies a repulsive magnetic force to the at least first, second and third magnetic particles in the mixture, causing the at least first, second and third magnetic particles to be separated from one another and flow into the first, second and third outlet channels, respectively, due to their separate and distinct properties.

In a further alternative embodiment, the outlet channels of the previous embodiments may be replaced by a separating chamber, which has an inlet port in fluid communication with the outlet end of the elongated hollow channel. In this embodiment, at least first, second and third sets of receptacles are defined in a peripheral wall of the separating chamber. The peripheral wall of the separating chamber may have any suitable type of shape, for example, being substantially semi-circular, substantially rectangular, or substantially circular.

As in the previous embodiments, an externally magnetizable wire extends along a transverse axis that is orthogonal to the longitudinal axis. The externally magnetizable wire is positioned adjacent the separating chamber and is diametrically opposed with respect to the outlet end of the elongated hollow channel. At least one magnetic source generates an external magnetic field along a lateral axis that is substantially orthogonal to the longitudinal axis and the transverse axis, such that the external magnetic field generates an induced magnetic field in the externally magnetizable wire. The induced magnetic field applies a repulsive magnetic force to the at least first, second and third magnetic particles, such that the at least first, second and third magnetic particles are separated to respectively flow into the at least first, second and third sets of receptacles due to their separate and distinct properties.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
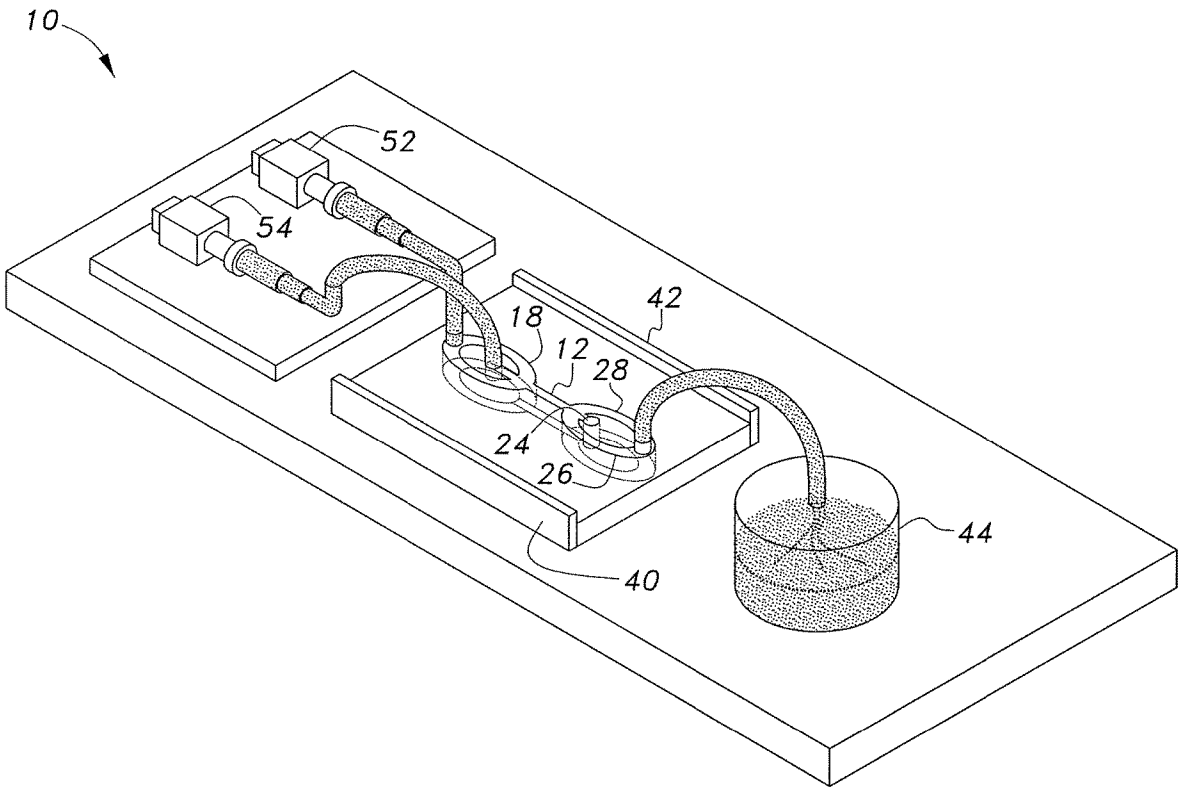
FIG. 1 is a perspective view of a magnetic particle separator.
Figure 2:
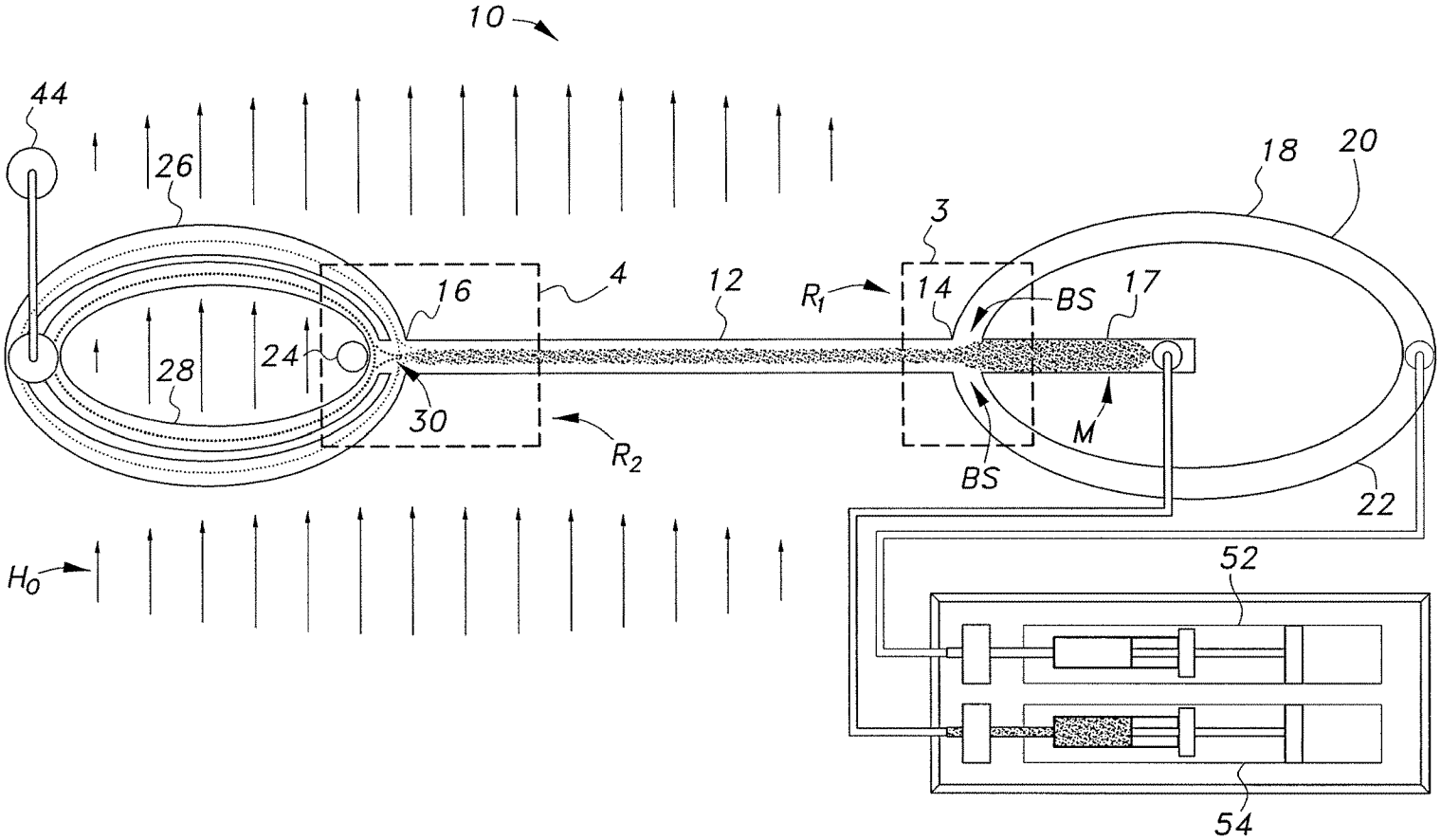
FIG. 2 is a diagrammatic top view of a magnetic particle separator.

The magnetic particle separator 10 uses an induced magnetic field to separate magnetic particles held in solution by magnetophoresis. The magnetic particles may be, for example, inherently paramagnetic or superparamagnetic, or may be magnetically tagged, or the like. As best shown in FIGS. 1 and 2, the magnetic particle separator 10 includes an elongate hollow channel 12 having opposed inlet and outlet ends 14, 16, respectively, extending along a longitudinal axis (i.e., the X-axis in the orientation of FIG. 1). The channel 12 may be a substantially rectangular hollow channel, and may be dimensioned and configured to force a wide, thin flow. It should be understood that the configuration of the magnetic particle separator 10 shown in the Figures is shown for exemplary purposes only, and that the same principles and primary elements described with relation thereto may be applied to separators having a wide variety of configurations, such as, for example, magnetic particles separators designed for separation of more than two different types of particles into a corresponding number of receptacles, as well as asymmetric configurations where target particles are separated into arrayed or aligned receptacles.

A mixture port 17 is disposed at the inlet end 14 of the hollow channel 12 for injecting a mixture M of first and second magnetic particles into the hollow channel 12. The first and second magnetic particles have separate and distinct properties with respect to one another, such as magnetic susceptibility, size, mass, or a combination thereof. A buffer port 18 is also disposed at the inlet end 14 of the hollow channel 12 for injecting a buffer solution BS into the hollow channel 12. The mixture M of the first and second magnetic particles in the buffer solution BS flows through the hollow channel 12 along the longitudinal direction toward the outlet end 16 of hollow channel 12.

Figure 3:
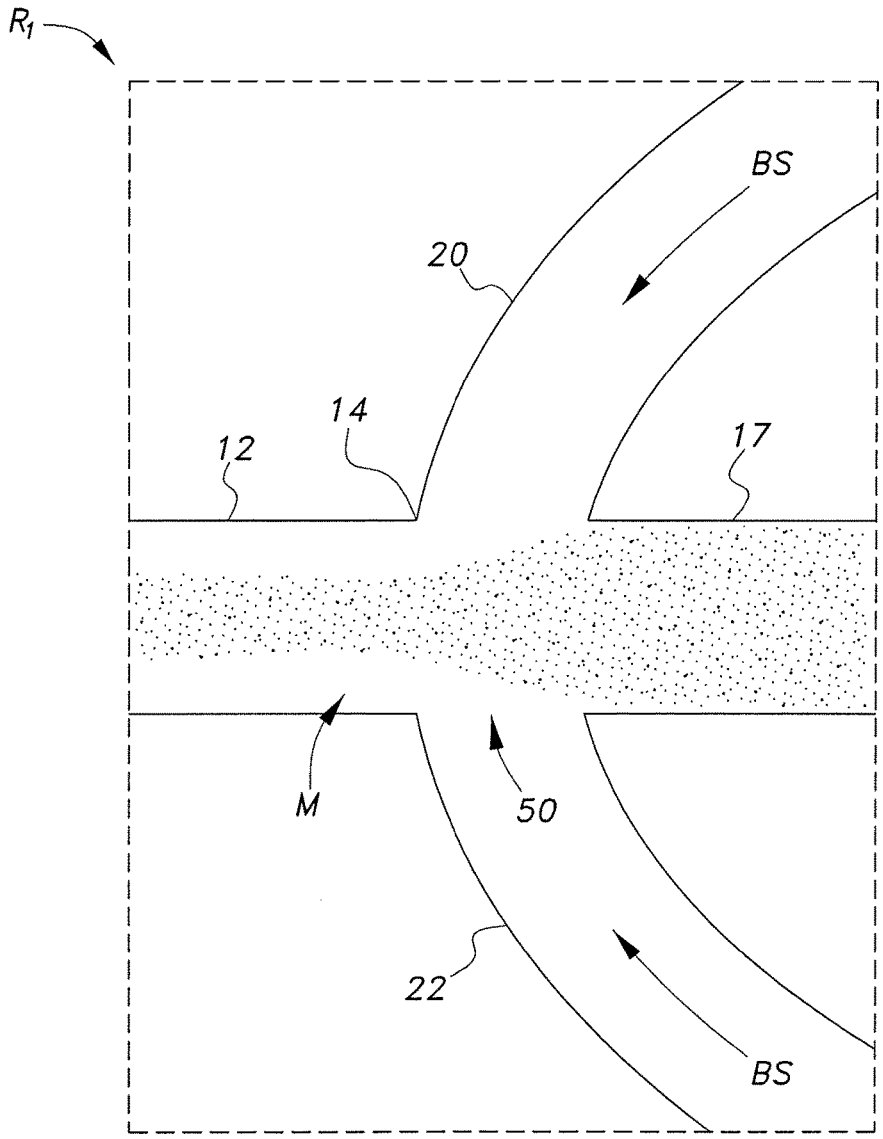
FIG. 3 is an enlarged top view of region $R_1$ of FIG. 2.

Preferably, as best shown in FIG. 2, the buffer port 18 is formed from first and second branches 20, 22, respectively, which are positioned symmetrically about the mixture port 17, such that flow of the buffer solution BS from both of the first and second branches 20, 22 hydrodynamically focuses flow of the mixture M containing the first and second target magnetic particles in the buffer solution through the hollow channel 12. As best shown in FIG. 3, which provides an enlarged view of region $R_1$ of FIG. 2, the buffer solution BS flowing from both the first branch 20 and the second branch 22 into the junction 50 with the mixture port 17 and the inlet end 14 of hollow channel 12 hydrodynamically focuses the longitudinal flow of the mixture M within the hollow channel 12.

Returning now to FIG. 2, although the buffer port 18 is shown as being substantially elliptical, it should be understood that this configuration is shown for exemplary purposes only, and any suitable configuration may be used, preferably with the first and second branches 20, 22, respectively, feeding into the junction 50 symmetrically about the mixing port 17 and the hollow channel 12. In FIGS. 1 and 2, the mixture M containing the first and second target magnetic particles is shown being injected into mixture port 17 by a syringe pump 54. Similarly, the buffer solution BS is shown being injected into buffer port 18 by a syringe pump 52. It should be understood that syringe pumps 52, 54 are shown for exemplary purposes only, and that the mixture M and the buffer solution BS may be injected into mixture port 17 and buffer port 18, respectively, by any suitable method.

First and second outlet channels 26, 28, respectively, are disposed at the outlet end 16 of the hollow channel 12, and may extend laterally away from the outlet end 16, and may extend symmetrically to both sides. Each of the first and second outlet channels 26, 28 is in fluid communication with each other, as well as with the outlet end 16 of the hollow channel 12, at a junction 30. Preferably, as shown, each of the first and second outlet channels 26, 28 has a substantially elliptical configuration, and the channels 26, 28 are positioned substantially concentrically such that the first outlet channel 26 has a larger radius (or larger circumference) than the second outlet channel 28. However, it should be understood that first and second outlet channels 26, 28 may have any other suitable configuration such that their respective distances from externally magnetizable wire 24 (as will be described in greater detail below) are unequal.

As noted above, the particular symmetric configuration shown in the Figures is shown for exemplary purposes only, and the configuration of first and second outlet channels 26, 28 particularly corresponds to a situation involving a mixture of two separate and distinct types of magnetic particles. It should be understood that the configuration may be varied to include further channels (having any suitable type of contouring or configuration) corresponding to magnetic particle types greater than two.

Further, for purposes of simplification, only one receptacle 44 is shown. It should be understood that a plurality of receptacles, one for each type of magnetic particle, may be provided in any desired configuration, such as aligned or arrayed rows of receptacles. As an alternative, it should be understood that the target particles may be retained within the outlet channels.

The externally magnetizable wire 24 extends along a transverse axis (i.e., the Z-axis in the configuration of FIG. 1) orthogonal to the longitudinal axis (i.e., the X-axis) of the channel 12, and is positioned adjacent the junction 30 and internal (i.e., inside the elliptical loop defined by the channels 26, 28) to the first and second outlet channels 26, 28, as shown. At least one magnetic source is provided for generating an external magnetic field $H_0$ along a lateral axis (i.e., the Y-axis in the configuration of FIG. 1) orthogonal to the longitudinal axis (i.e., the X-axis) defined by the channel 12 and the transverse axis (i.e., the Z-axis) defined by the wire 24. In FIG. 1, two magnets 40, 42 are shown generating the external magnetic field $H_0$ along the lateral axis, although it should be understood that any suitable arrangement of permanent magnets, electromagnets or the like may be used for generating a magnetic field along the lateral axis. The externally magnetizable wire 24 may be a ferromagnetic wire or may be formed from any suitable type of magnetizable substance, such as nickel, permalloy or the like.

Figure 4:
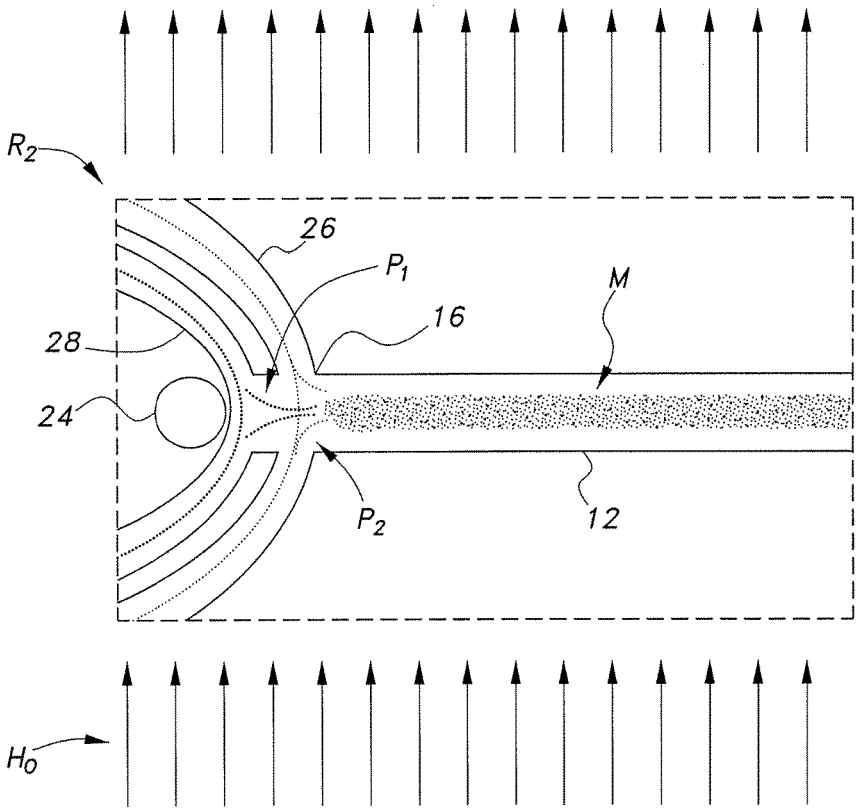
FIG. 4 is an enlarged top view of region $R_2$ of FIG. 2.

The external magnetic field $H_0$ generates an induced magnetic field in, and in the nearby region or area of, the externally magnetizable wire 24, and this induced magnetic field results in a repulsive magnetic force applied to the first and second magnetic particles in the mixture M. As best shown in FIG. 4, which provides an enlarged view of region $R_2$ of FIG. 2, due to the separate and distinct properties of the first and second magnetic particles $P_1$ and $P_2$, respectively, in mixture M, and due to the difference in distance from the wire 24 to the first and second outlet channels 26, 28, respectively, due to the unequal radii of first and second outlet channels 26, 28, the first and second magnetic particles $P_1$ and $P_2$, respectively, are separated from one another to flow into the outlet channels 28 and 26, respectively. Here, the separation is primarily due to the fact that two types of target particles $P_1$ and $P_2$ experience different responses to the repulsive magnetic force generated by the wire 24 at its side facing junction 30; i.e., they are experiencing differential deflections and mobilities from wire 24 due to the opposing repulsive force.

In the magnetic particle separator 10, the sorting and/or separation is based on the differential deflections of the flowing magnetic or magnetically labeled targets when faced by a localized, low-level magnetic field region induced by a high magnetic gradient concentrator (HGMC); i.e., the externally magnetizable wire 24. The repulsive deflections from this region are driven by the magnetophoretic force directed from the decreasing magnetic gradient toward the increasing gradient regions around the HGMC.

It is important to note that the particle separation of the first and second magnetic particles $P_1$ and $P_2$, respectively, in the mixture M is not produced by the magnetic force generated from the external magnetic field $H_0$, but rather from an induced magnetic field H, which is generated from external magnetic field $H_0$ acting on externally magnetizable wire 24. When exposed to a uniform one-dimensional external magnetic field $H_0=H_0e_y$, the magnetic potential, co, around a circular ferromagnetic wire of radius a can be expressed with respect to the element's center as:

$$\varphi = -H_o y + kH_o a^2 \frac{y}{(x^2+y^2)},$$

where $r=\sqrt{x^2+y^2}>a$.

Here, r represents the radius from the center of externally magnetizable wire 24 and k is given by:

$$k = \frac{\mu_w - \mu_o}{\mu_w + \mu_o},$$

where $\mu_0$ is the magnetic permeability of free space and $\mu_w$ is the magnetic permeability of the ferromagnetic wire 24. It is assumed that the magnetic permeability of the carrier fluid is approximately equal to that of free space (i.e., $\mu_0$). Since $H=-\nabla\varphi$ (assuming a non-rotational magnetic field), the induced magnetic field by the wire 24 can be expressed as:

$$H = \frac{H_o}{(x^2+y^2)^2}\left[[2a^2kxy]e_x + \left[(x^2+y^2)^2 - a^2k(x^2-y^2)\right]e_y\right]. \quad (1)$$

Here, a uniform one-dimensional external magnetic induction field ($B_0e_y=\mu_0H_0e_y$) becomes non-homogenous and mainly two-dimensional in the nearby region of a long ferromagnetic structure. The induced magnetic polarity on the wire 24 creates opposing magnetic field gradients. For purposes of simplification, the magnetic particle is considered to be a magnetic bead modeled as a point-like magnetic dipole. The magnetic force on such a magnetic bead is given by:

$$F_{mag} = \frac{1}{2}\mu_o \chi V_p \nabla H^2, \quad (2)$$

where $\chi$ and $V_p$ are, respectively, the effective magnetic susceptibility and the volume of the magnetic bead. Thus, from equation (1), $$H^2 = H_o^2\left(1 + \frac{2a^2k}{x^2+y^2} + \frac{a^2k(a^2k-4x^2)}{(x^2+y^2)^2}\right).$$

From this, the magnetic force components are:

$$F_{mx} = -2\mu_o\chi V_p H_o^2 a^2 k \frac{(ka^2 - x^2 + 3y^2)x}{(x^2+y^2)^3}, \text{ and} \quad (3)$$

$$F_{my} = -2\mu_o\chi V_p H_o^2 a^2 k \frac{(ka^2 - 3x^2 + y^2)y}{(x^2+y^2)^3}. \quad (4)$$

Based on the saturation magnetization $M_{ws}$ of the circular ferromagnetic wire 24, k can be adapted for both magnetically non-saturated and magnetically saturated conditions as:

$$k = \begin{bmatrix} 1.0 & \text{if } H_o \le \frac{M_{ws}}{2}; \text{(non-sat)} \\ \frac{M_{ws}}{2H_o} & \text{if } H_o > \frac{M_{ws}}{2}; \text{(sat)} \end{bmatrix}. \quad (5)$$

The axial and vertical components of the magnetic force will divert the magnetic beads toward capture along the lateral direction (i.e., up and down along the Y-axis, into the first and second outlet channels 26, 28) while averting their capture along the longitudinal direction (i.e., along the X-axis).

For the case in which paramagnetic or superparamagnetic beads are suspended in a stagnant fluid surrounding a ferromagnetic wire, which is located adequately far from walls, the beads will experience a repulsive force along the longitudinal direction, diverting them above and below along the lateral direction. In the configuration of FIGS. 1 and 2, the particles are diverted along the Y-axis, in both directions, where magnetic attraction becomes predominant.

Simplified particle motion can be described as the balance between the inertia force and the sum of body, surface, and other external forces, i.e.

$$m_p \frac{du_p}{dt} = \sum F_{ex},$$

where $m_p$ and $u_p$ are the mass and the velocity of the particle, respectively. The forces acting on a dispersed magnetic particle can be due to many influences. In addition to the induced magnetic force, the particle will be subject to forces relating to drag, gravitational, lift, fluid-particle, particle-particle, particle-walls as well as the effect of Brownian motion. For microscale particles in a state of dilute suspension within a liquid with comparable density, the forces due to Brownian motion, lift and particle-particle interactions are very small and can be neglected. By considering only the remaining dominant forces, the particle's motion can be described by:

$$m_p \frac{du_p}{dt} = 6\pi\eta a(u - u_p) + V_p(\rho_p - \rho)g + F_m, \tag{6}$$

where u, ρ, and η are the velocity, density and viscosity for the carrier fluid, respectively, and $\rho_p$, a, and $V_p$ are the density, radius and volume of the particle, respectively, and g is the gravitational field. The first term on the right hand side of equation (6) accounts for the drag on the particle. The second and third terms are the buoyant and magnetic forces, respectively. In the Lagrangian approach, the motion of discrete particles is tracked by the time integration of the dynamics equation above along with the kinematic equation $$\frac{dx_p}{dt} = u_p.$$

The particles, driven by magnetic force, move at velocities different than that of the ambient fluid. The relative velocity comes as results of the magnetophoretic mobility attained when the magnetic force is strong enough to overcome the drag (or other body or surface forces) imposed by the carrier fluid. For a small particle, the acceleration phase (relaxation time) is negligibly small, and therefore the relative velocity establishes almost instantaneously under the local equilibrium between the magnetic and other dominant forces. Under local equilibrium, the Stokes flow conditions apply, and therefore the inertia (acceleration) force of the particle can be neglected. Assuming that the magnetization of the particles is not significantly interfering with that generated around the wire 24, the external magnetic force field $H_0$ can be assumed steady and independent of the particle concentration of the particles.

The overall motion of the magnetic particles will be mainly influenced by the attracting/repelling magnetic forces and by the surface (i.e., mainly drag) forces. It is important to note that if the goal is to deflect the motion into a target path and not to capture or immobilize them, one has to optimally position the wire to maximize the utility of the repulsive forces, while at the same time avoiding the threshold of the attractive forces. The positioning of the wire can be either invasive to the flow or non-invasive (i.e., embedded at walls or outside of the channel). A more challenging optimization task is to utilize the repulsive force to steer multi-target beads into distinct paths (based on their sizes and magnetic dealings) to achieve simultaneous sorting with high purity and recovery. In principle, one must not rely solely on the differing in susceptibilities or magnetic saturation of poly-sized particles to achieve distinct dealing. These differences can be offset by hydrodynamic effects, leading to similar magnetophoretic mobilities. Therefore, the distinctive steering parameter of a magnetic particle preferably takes into consideration the combined effects of its geometry, mass and magnetic properties.

Experiments and simulations were carried out using a variety of magnetic beads. In the simulations, Dynabeads® MyOne beads, Dynabeads® M-280 Streptavidin beads, and Dynabeads® M-450, each manufactured by Invitrogen Dynal of Norway (with well documented magnetic properties). Table 1 below provides the magnetic properties of each type of bead.

TABLE 1

Magnetic Properties of the Experimental Beads

| Bead type | $d_b$ (μm) | $\rho_b$ (kg/m$^3$) | $\chi_{b,eff}$ (—) | $M_{sat}$ (A/m) | $\chi$ (m$^3$/kg) | $M_o$ (Am$^2$/kg) |
|---|---|---|---|---|---|---|
| MyOne | 1.0 | 1791.0 | 1.43 | $4.3 \times 10^4$ | 1.45 | $4.21 \times 10^4$ |
| M-280 | 2.8 | 1538.0 | 0.923 | $2.0 \times 10^4$ | 0.83 | $1.661 \times 10^4$ |
| M-450 | 4.5 | 1578.0 | 1.58 | $3.0 \times 10^4$ | 1.61 | $3.08 \times 10^4$ |

Using the three types of beads listed in Table 1 as exemplary particles to be separated by the magnetic particle separator 10, exemplary parameters for such a separator include widths of buffer port 18 and mixture port 16 of approximately 200 μm, widths for first and second outlet channels 26, 28 of approximately 100 μM, a radial spacing between first and second outlet channels 26, 28 of approximately 100 μm, a wire diameter of between approximately 127 and approximately 508 μm, inlet velocities for both buffer solution BS and mixture M of approximately 5 mm/s, a saturation magnetization of wire 24 of $8.6\times10^5$ A/m, and an applied external magnetic field $H_0$ of approximately 0.5 T.

It should be noted that in FIGS. 1 and 2, a single receptacle 44 is shown for receiving one of the separated volumes of particles $P_1$ or $P_2$. It should be understood that the separated particles may be separated one at a time, or multiple such receptacles may be provided. Further, any suitable type of pump or extractor may be utilized for extracting the separated particles for collection in receptacle(s) 44. Further, it should be understood that although only two types of particles are used in mixture M, the magnetic particle separator 10 may be used for separating more than two types of particles by the addition of additional corresponding outlet channels.

It should be further understood that in addition to the repulsive magnetic force generated by the induced magnetic field in externally magnetizable wire 24, additional steering of the repelled magnetic particles $P_1$ and $P_2$ may be enhanced and tuned by the attractive force induced by other HGMCs or other source(s) of external magnetic field $H_0$.

It is important to note that the magnetic particle separator 10 primarily relies on the differential deflections experienced by the target magnetic particles by the repulsive magnetic force induced by the externally magnetizable wire 24 (or a similar structure). It should be understood that although described above as separating first and second magnetic particles $P_1$ and $P_2$, the magnetic particle separator 10 may be used for the manipulation and/or separation of one, two or more types of magnetic particles.

Further, it should be noted that the throughput of the magnetic particle separator 10 is scalable; i.e., the throughput can be increased indefinitely by increasing the length of the externally magnetizable wire 24. The repulsive magnetic force generated by the magnetic field induced on the externally magnetizable wire 24 (as opposed to direct magnetic interaction of the external magnetic field with the magnetic particles $P_1$ and $P_2$) allows the magnetic particle separator 10 to deflect the magnetic particles $P_1$ and $P_2$ into spatially addressable routes. The separated target particles may then be collected and immobilized for detection or surface processing.

With such scaling, volumetric pumping can be correspondingly scaled-up by extending the size of system 10 while also maintaining the full utility of the short-ranged repulsive force and without having to increase the velocity of the introduced sample mixture M. For a circular ferromagnetic wire 24, in the presence of a uniform magnetic field $H_0$, the repulsive magnetic force exists over a limited angular expanse of its circumference. Therefore, to ensure rapid differential deflections, the sample flow must be hydrodynamically focused toward the center of the repulsive side of the wire 24 and the wire 24 must be relatively larger than the focused stream.

It should be understood that the magnetic particle separator 10 can be integrated with other down-stream processes and/or be integrated into controlled platforms. As an example, the magnetizable wire 24 may be provided as part of a platform or on-chip system where the externally magnetizable wire 24 is selectively positionable. The external magnetic field source could also be made to be selectively positionable. This could be accomplished via a micropositioning stage or the like, thus allowing the system to be pre-programmed according to a desired sorting protocol.

Returning to FIG. 3, the injected sample, as described above, is focused by sheath flows or other focusing means into a thin sheet so as to approach the low field (i.e., repulsive) side of the ferromagnetic wire 24, or the like, that traverses the flow direction and spans the whole depth of the sorting chamber. As shown in FIG. 4, once approaching the low magnetic field region at the wire 24, the magnetic particles carried by the focused sample sheet fractionate from their laminar paths, according to their distinctive dealings with the repulsive magnetic force, into ribbon-like sub-sheets, which can then be directed toward spatially addressable outlets.

It should be further understood that the magnetic particle separator 10 is not limited to the symmetric embodiment described above, and may have any suitable configuration, including separation into multiple arrayed or aligned receptacles for receiving corresponding separated particles.

Figure 5:
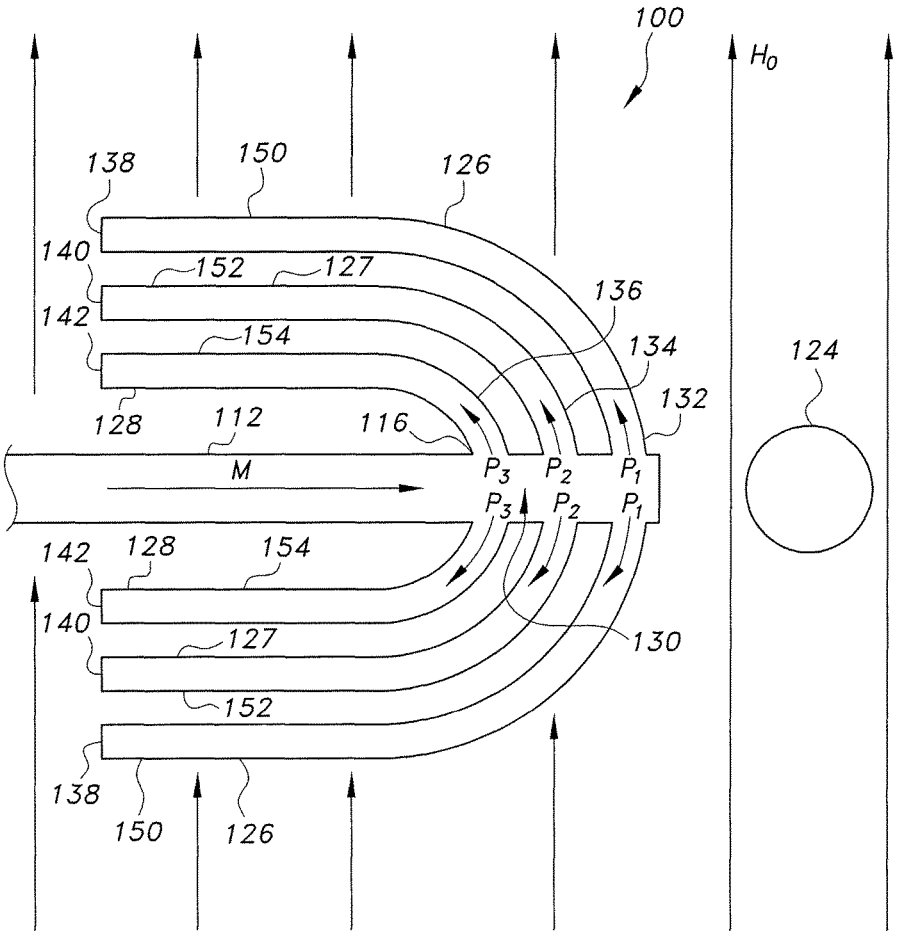
FIG. 5 is a diagrammatic, partial top view of an alternative embodiment of a magnetic particle separator.

Although an exemplary mixture of only two types of particles is described above, it should be understood that the mixture may contain any suitable number of different types of particles. In the alternative embodiment of FIG. 5, in which the magnetic particle separator 100 is configured for a mixture of at least three types of particles ($P_1$, $P_2$, and $P_3$), the first and second elliptical outlet channels 26, 28 of the previous embodiment are replaced by first, second and third outlet channels 126, 127, 128, respectively. It should be understood that the magnetic particle separator 100 utilizes an identical injection system to that of the magnetic particle separator 10 for focusing and injecting the mixture M through an elongated hollow channel 112. As shown in FIG. 5, first, second and third outlet channels 126, 127, 128, respectively, are each disposed at the outlet end 116 of the elongated hollow channel 112. In this embodiment, each of the first, second, and third outlet channels 126, 127, 128, respectively, has a substantially U-shaped configuration. The first, second and third outlet channels 126, 127, 128 respectively have first, second, and third pairs of branches 150, 152, 154 distal from the channel 112, and first, second and third central portions 132, 134, 136 proximal the channel 112.

The first, second and third outlet channels 126, 127, 128, respectively, are in fluid communication with each other at a junction 130 defined therebetween. As shown, the third central portion 136 is positioned adjacent the outlet end 116 of the elongated hollow channel 112. As in the previous embodiment, an externally magnetizable wire 124 extends along a transverse axis orthogonal to the longitudinal axis, such that the externally magnetizable wire 124 is positioned adjacent the first central portion 132 of the first outlet channel 126. The second central portion 134 of the second outlet channel 127 is positioned between the first central portion 132 of the first outlet channel 126 and the third central portion 136 of the third outlet channel 128, i.e., the third central portion 136 of the third outlet channel 128 is positioned closest to the outlet end 116 of elongated hollow channel 112 and farthest from the externally magnetizable wire 124. The first central portion 132 of the first outlet channel 126 is positioned farthest from the outlet end 116 of elongated hollow channel 112 and closest to the externally magnetizable wire 124, and the second central portion 134 of the second outlet channel 127 is positioned between the first central portion 132 and the third central portion 136.

As in the previous embodiment, at least one magnetic source generates an external magnetic field $H_0$ along a lateral axis that is substantially orthogonal to the longitudinal axis and the transverse axis, such that the external magnetic field $H_0$ generates an induced magnetic field in the externally magnetizable wire 124. The induced magnetic field applies a repulsive magnetic force to the first, second and third particles $P_1$, $P_2$, $P_3$, respectively, in the mixture M, causing the first, second and third particles $P_1$, $P_2$, $P_3$, respectively, to be separated from one another and flow into the first, second and third outlet channels 126, 127, 128, respectively, due to their separate and distinct properties. As in the previous embodiment, the elongated hollow channel 112 may have a rectangular cross-section. Further, each of the branches 150, 152, 154 preferably terminates in a respective receptacle, such that particles $P_1$ (1 μm diameter) may be collected in receptacles 138, particles $P_2$ (2.8 μm diameter) may be collected in receptacles 140, and particles $P_3$ (4.5 μm diameter) may be collected in receptacles 142. As shown, the first, second and third outlet channels 126, 127, 128, respectively, are preferably arranged symmetrically about the longitudinal axis, and central portions 132, 134, 136 are preferably in line along the longitudinal axis with wire 124.

As in the previous embodiment, the distinctive steering parameter for a magnetic particle must take into consideration the combined effects of its geometry and magnetic properties. In magnetic particle separator 100, design parameters that may be varied include the distance between the wire 124 and the first outlet channel 126, the diameter of the wire 124, and the velocity and pressure conditions of mixture M, both with regard to focused injection, and also at outlet 116.

Figure 6:
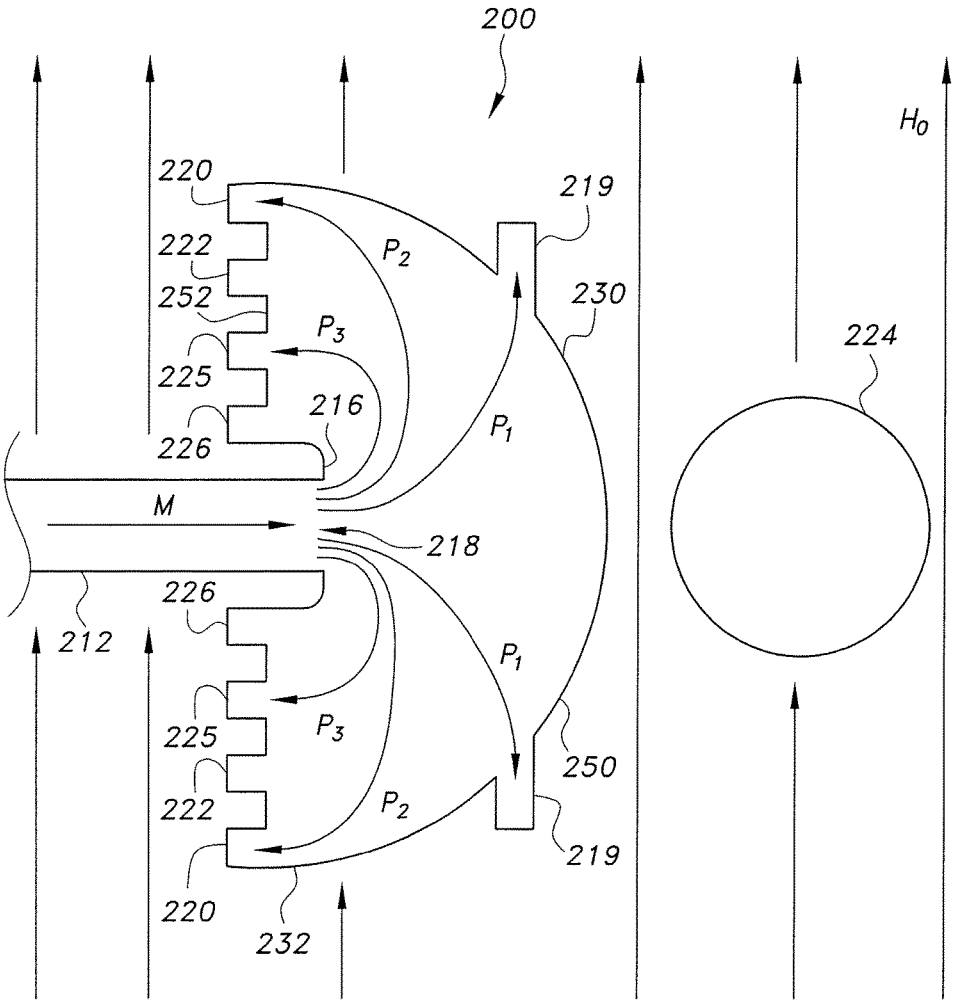
FIG. 6 is a diagrammatic, partial top view of another alternative embodiment of a magnetic particle separator.

In the further alternative embodiment of FIG. 6, the outlet channels of the previous embodiments are replaced by a separating chamber 230 that has an inlet port 218 in fluid communication with the outlet end 216 of the elongated hollow channel 212. It should be understood that the magnetic particle separator 200 of FIG. 6 utilizes an identical injection system to that of the magnetic particle separator 10 for focusing and injecting the mixture M through an elongated hollow channel 212. In the magnetic particle separator 200, at least first, second and third sets of receptacles 219, 220, 225, respectively, are defined in a peripheral wall 232 of the separating chamber. In the example of FIG. 6, the mixture M is made up of first particles $P_1$, second particles $P_2$ (2.8 μm diameter) and third particles $P_3$ (4.5 μM diameter). However, it should be understood that additional particle types may be added to the mixture M. Thus, exemplary additional sets of receptacles 222, 226 are also shown in FIG. 6. The peripheral wall 232 of the separating chamber 230 may have any suitable type of configuration. In the example of FIG. 6, peripheral wall 232 is semi-circular, having an arcuate portion 250 and a linear portion 252. As shown, the first set of receptacles 219 may be defined in arcuate portion 250, and the remaining sets of receptacles 220, 222, 225, 226 may be defined in the linear portion 252. As in the previous embodiment, the elongated hollow channel 212 may have a rectangular cross-section. The first set of receptacles 219 may be provided for non-magnetic particles $P_1$, which are deflected into the receptacles 219 by the geometry of the separating chamber 230 and hydrostatic or hydrodynamic forces, rather than through magnetic deflection.

As in the previous embodiments, an externally magnetizable wire 224 extends along a transverse axis that is orthogonal to the longitudinal axis. The externally magnetizable wire 224 is positioned adjacent the separating chamber 230 and is diametrically opposed with respect to the outlet end 216 of the elongated hollow channel 212. At least one magnetic source generates an external magnetic field $H_0$ along a lateral axis that is substantially orthogonal to the longitudinal axis and the transverse axis, such that the external magnetic field $H_0$ generates an induced magnetic field in the externally magnetizable wire 224. The induced magnetic field applies a repulsive magnetic force to the second and third magnetic particles $P_2$ and $P_3$, respectively, such that the second and third magnetic particles $P_2$, $P_3$, respectively, are separated to respectively flow into the second and third sets of receptacles 220, 225 due to their separate and distinct properties. As in the previous embodiment, the distinctive steering parameter for a magnetic particle must take into consideration the combined effects of its geometry and magnetic properties. In the magnetic particle separator 200, design parameters that may be varied include the distance between the wire 224 and the separation chamber 230, the diameter of the wire 224, and the velocity and pressure conditions of mixture M, both with regard to focused injection, and also at outlet 216. As shown, the separating chamber 230 is preferably symmetric about the longitudinal axis and wire 224 is preferably in line with the elongated hollow channel 212 along the longitudinal axis.

Figure 7:
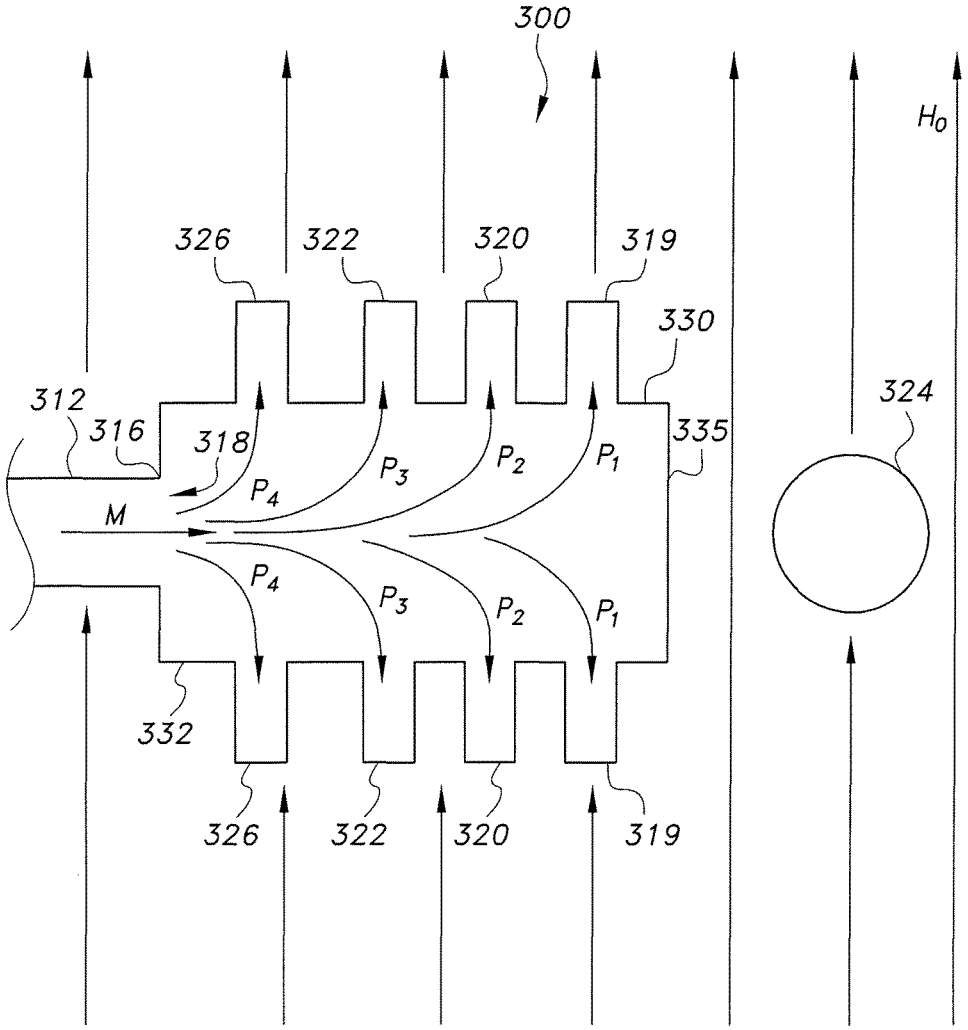
FIG. 7 is a diagrammatic, partial top view of a further embodiment of a magnetic particle separator.

The embodiment of FIG. 7 is similar to that of FIG. 6, but the exemplary semi-circular separating chamber 230 of FIG. 6 has been replaced with an exemplary rectangular separating chamber 330, which, as in the previous embodiment, has an inlet port 318 in fluid communication with the outlet end 316 of the elongated hollow channel 312. It should be understood that the magnetic particle separator 300 of FIG. 7 utilizes an identical injection system to that of the magnetic particle separator 10 for focusing and injecting the mixture M through an elongated hollow channel 312. In magnetic particle separator 300, an exemplary mixture of four types of particles $P_1$, $P_2$, $P_3$, $P_4$ is utilized. Correspondingly, first, second, third and fourth sets of receptacles 319, 320, 322, 326, respectively, are defined in a peripheral wall 332 of the separating chamber 330, the peripheral wall 332 including an end wall 335. As in the previous embodiment, the elongated hollow channel 312 may have a rectangular cross-section. The first set of receptacles 319 may be provided for non-magnetic particles $P_1$, which are deflected into the receptacles 319 by the geometry of the separating chamber 330 and hydrostatic or hydrodynamic forces, rather than through magnetic deflection.

As in the previous embodiments, an externally magnetizable wire 324 extends along a transverse axis that is orthogonal to the longitudinal axis. The externally magnetizable wire 324 is positioned adjacent the separating chamber 330 and is diametrically opposed with respect to the outlet end 316 of the elongated hollow channel 312. At least one magnetic source generates an external magnetic field $H_0$ along a lateral axis that is substantially orthogonal to the longitudinal axis and the transverse axis, such that the external magnetic field $H_0$ generates an induced magnetic field in the externally magnetizable wire 324. The induced magnetic field applies a repulsive magnetic force to the second, third and fourth magnetic particles $P_2$ (1 μm diameter), $P_3$ (2.8 μm diameter), $P_4$ (4.5 μm diameter), respectively, such that the second, third, and fourth magnetic particles $P_2$, $P_3$, $P_4$, respectively, are separated to respectively flow into the second, third, and fourth sets of receptacles 320, 322, 326 due to their separate and distinct properties. As in the previous embodiment, the distinctive steering parameter for a magnetic particle must take into consideration the combined effects of its geometry and magnetic properties. In magnetic particle separator 300, design parameters that may be varied include the distance between the wire 324 and the separation chamber 330, the diameter of the wire 324, and the velocity and pressure conditions of the mixture M, both with regard to focused injection, and also at the outlet 316. As shown, the separating chamber 330 is preferably symmetric about the longitudinal axis and the wire 324 is preferably in line with the elongated hollow channel 312 along the longitudinal axis.

Figure 10:
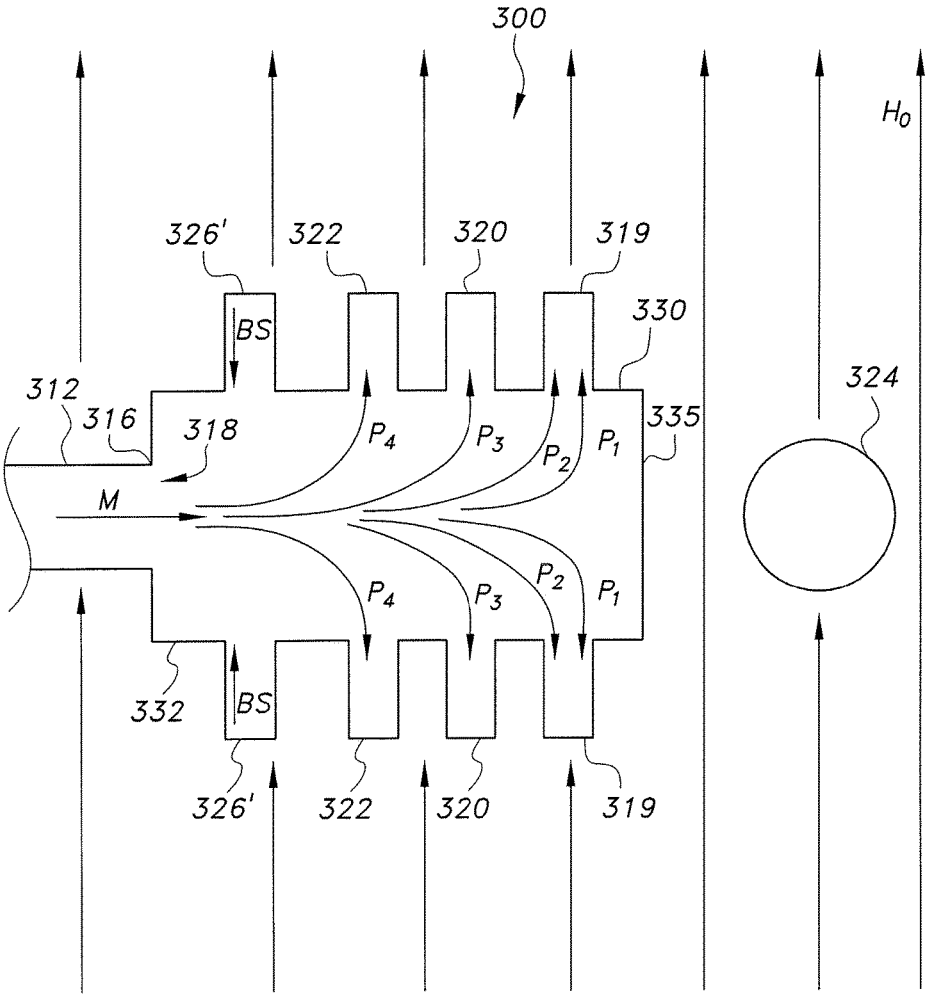
FIG. 10 is a diagrammatic, partial top view of another alternative embodiment of the magnetic particle separator.

In the alternative embodiment of FIG. 10, the magnetic particle separator 300 has been modified by replacing the fourth set of receptacles 326 with a switchable set of inlets 326'; i.e., in an open configuration, inlets 326' allow for the input of additional buffer solution BS, and in a closed configuration, inlets 326' close to form receptacles similar to receptacles 326 of FIG. 7. This further enhances the system's controllability, allowing, as shown, both particles $P_1$ and particles $P_2$ to be collected in the first set of receptacles 319. It should be understood that any desired set (or multiple sets) of receptacles may be alternatively replaced by such inlets.

Figure 8:
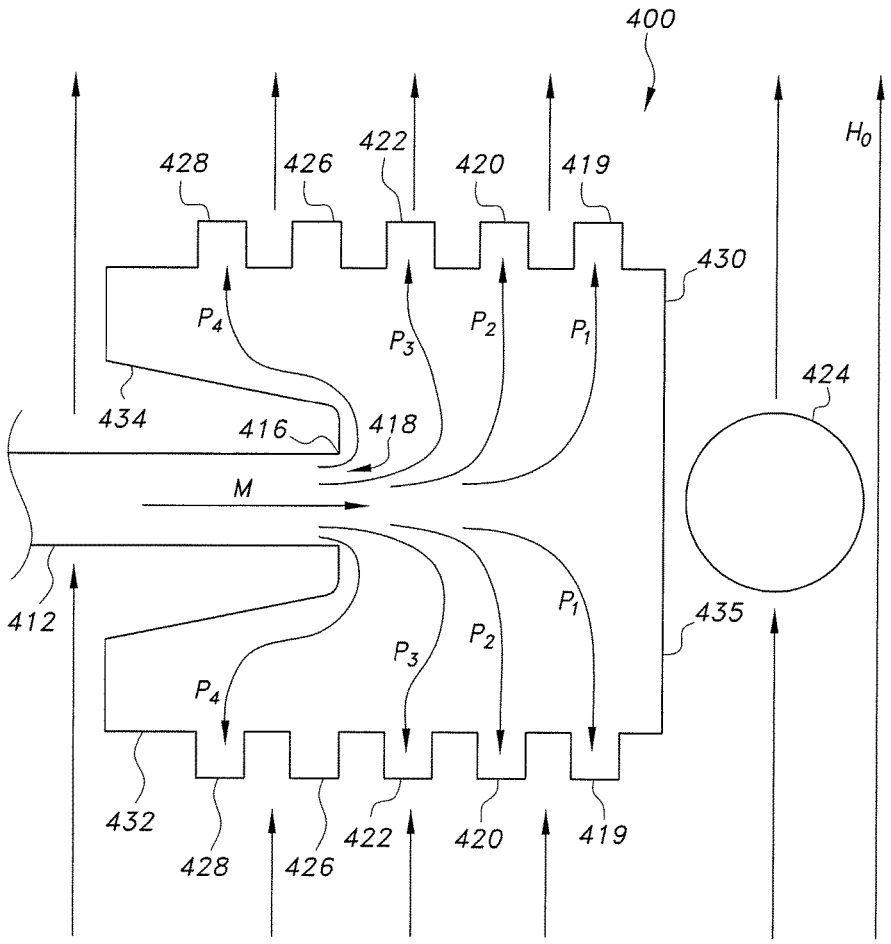
FIG. 8 is a diagrammatic, partial top view of yet another alternative embodiment of the magnetic particle separator.

The embodiment of FIG. 8 is similar to that of FIG. 7, but one wall 434 of a substantially rectangular separation chamber 430 is provided with a recess or cutout adjacent the outlet 416 of the elongated hollow channel 412. The substantially rectangular separation chamber 430 has an inlet port 418 in fluid communication with the outlet end 416 of the elongated hollow channel 412. It should be understood that the magnetic particle separator 400 of FIG. 8 utilizes an identical injection system to that of the magnetic particle separator 10 for focusing and injecting the mixture M through the elongated hollow channel 412. In the magnetic particle separator 400, an exemplary mixture of four types of particles $P_1$, $P_2$, $P_3$, $P_4$ is utilized. Correspondingly, at least first, second, third and fourth sets of receptacles 419, 420, 422, 428, respectively, are defined in a peripheral wall 432 of the separating chamber 430, the peripheral wall 432 including an end wall 435. As shown, an exemplary fifth set of receptacles 426 may be provided, allowing the separation chamber 430 to be further adapted for a mixture M formed from five separate types of particles. As in the previous embodiment, the elongated hollow channel 412 may have a rectangular cross-section. The first set of receptacles 419 may be provided for non-magnetic particles $P_1$, which are deflected into the receptacles 419 by the geometry of the separating chamber 430 and hydrostatic or hydrodynamic forces, rather than through magnetic deflection.

As in the previous embodiments, an externally magnetizable wire 424 extends along a transverse axis that is orthogonal to the longitudinal axis. The externally magnetizable wire 424 is positioned adjacent the separating chamber 430 and is diametrically opposed with respect to the outlet end 416 of the elongated hollow channel 412. At least one magnetic source generates an external magnetic field $H_0$ along a lateral axis that is substantially orthogonal to the longitudinal axis and the transverse axis, such that the external magnetic field $H_0$ generates an induced magnetic field in the externally magnetizable wire 424. The induced magnetic field applies a repulsive magnetic force to the second, third, and fourth magnetic particles $P_2$ (1 μm diameter), $P_3$ (2.8 μm diameter), $P_4$ (4.5 μm diameter), respectively, such that the second, third, and fourth magnetic particles $P_2$, $P_3$, $P_4$, respectively, are separated to respectively flow into the second, third, and fourth sets of receptacles 420, 422, 428 due to their separate and distinct properties. As in the previous embodiment, the distinctive steering parameter for a magnetic particle must take into consideration the combined effects of its geometry and magnetic properties. In the magnetic particle separator 400, design parameters that may be varied include the distance between the wire 424 and the separation chamber 430, the diameter of the wire 424, and the velocity and pressure conditions of the mixture M, both with regard to focused injection, and also at the outlet 416. As shown, the separating chamber 430 is preferably symmetric about the longitudinal axis and the wire 424 is preferably in line with the elongated hollow channel 412 along the longitudinal axis.

Figure 9:
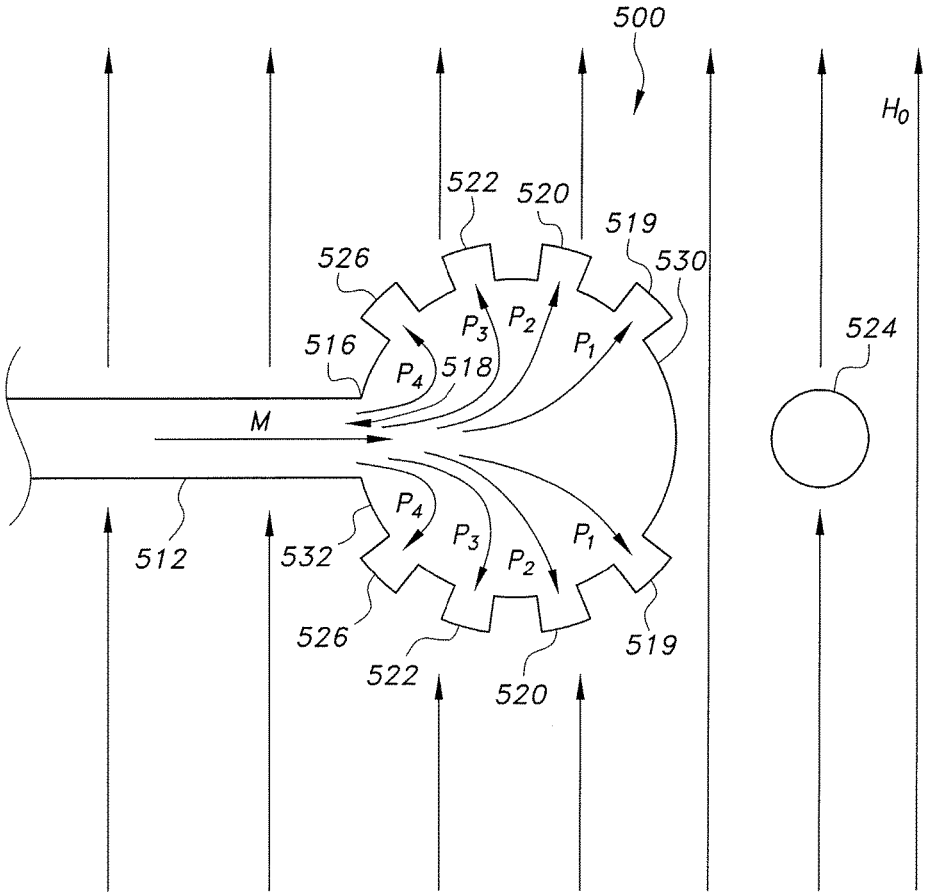
FIG. 9 is a diagrammatic, partial top view of still another alternative embodiment of the magnetic particle separator.

The embodiment of FIG. 9 is similar to that of FIGS. 7 and 8, but, as shown, the separation chamber 530 of the magnetic separator 500 is shown with an exemplary circular configuration. As in the previous embodiments, the separation chamber 530 has an inlet port 518 in fluid communication with the outlet end 516 of an elongated hollow channel 512. It should be understood that the magnetic particle separator 500 of FIG. 9 utilizes an identical injection system to that of the magnetic particle separator 10 for focusing and injecting the mixture M through the elongated hollow channel 512. In the magnetic particle separator 500, an exemplary mixture of four types of particles $P_1$, $P_2$, $P_3$, $P_4$ is utilized. Correspondingly, at least first, second, third and fourth sets of receptacles 519, 520, 522, 526, respectively, are defined in a peripheral wall 532 of the separating chamber 530. As in the previous embodiment, the elongated hollow channel 512 may have a rectangular cross-section. The first set of receptacles 519 may be provided for nonmagnetic particles $P_1$, which are deflected into the receptacles 519 by the geometry of the separating chamber 530 and hydrostatic or hydrodynamic forces, rather than through magnetic deflection.

As in the previous embodiments, an externally magnetizable wire 524 extends along a transverse axis that is orthogonal to the longitudinal axis. The externally magnetizable wire 524 is positioned adjacent the separating chamber 530 and is diametrically opposed with respect to the outlet end 516 of the elongated hollow channel 512. At least one magnetic source generates an external magnetic field $H_0$ along a lateral axis which is substantially orthogonal to the longitudinal axis and the transverse axis, such that the external magnetic field $H_0$ generates an induced magnetic field in the externally magnetizable wire 524. The induced magnetic field applies a repulsive magnetic force to the second, third and fourth magnetic particles $P_2$ (1 μm diameter), $P_3$ (2.8 μm diameter), $P_4$ (4.5 μm diameter), respectively, such that the second, third and fourth magnetic particles $P_2$, $P_3$, $P_4$, respectively, are separated to respectively flow into the second, third and fourth sets of receptacles 520, 522, 526 due to their separate and distinct properties. As in the previous embodiment, the distinctive steering parameter for a magnetic particle must take into consideration the combined effects of its geometry and magnetic properties. In the magnetic particle separator 500, design parameters that may be varied include the distance between the wire 524 and the separation chamber 530, the diameter of the wire 524, and the velocity and pressure conditions of the mixture M, both with regard to focused injection, and also at the outlet 516. As shown, the separating chamber 530 is preferably symmetrical about the longitudinal axis, and the wire 524 is preferably in line with the elongated hollow channel 512 along the longitudinal axis.

It will be noted that in the embodiments of FIGS. 5-9, the externally magnetizable wire is not disposed in the hollow channel or within the separating chamber. Rather, the wire is disposed on the exterior of the fluid-carrying device, although aligned orthogonal to the direction of fluid flow and in the path of fluid flow, the wire being positioned close enough to the fluid-carrying device that the magnetic field induced in the wire has sufficient strength to repel magnet particles carried in the fluid and the device being made of material that will not block the induced magnetic field. In FIG. 5, the channel 112 is a closed channel 112 with an end wall separating the channel 112 from the wire 124. In FIGS. 6-9, the peripheral wall of the separating chamber separates the channel from the wire, and also diverts the nonmagnetic particles P1 into their respective outlet channels, while the path of the magnetic particles P2, P3, and P4 is diverted to their respective outlet channels by the force of the induced magnetic repulsion field prior to reaching the end of the separating chamber.

In each of the embodiments above, it should be understood that the externally magnetizable wire, as well as the external magnetic source, can each be selectively positioned and/or controlled. Further, it should be understood that the flow outlets' and inlets' conditions (e.g., velocity and pressure) can be adjusted and altered. Further, it should be understood that more than one externally magnetizable wire can be used in order to utilize the repulsive and attractive fields (forming over a defined angular span on the wire circumferences) to tune the sorting mediated by their deflection.

It is to be understood that the magnetic particle separator is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A magnetic particle separator, comprising:

an elongated hollow channel extending along a longitudinal axis, the elongated hollow channel having opposed inlet and outlet ends and defining an unencumbered interior expanse;

a mixture port in communication with the inlet end of the elongated hollow channel for injecting a mixture of at least first, second and third magnetic particles into the elongated hollow channel, wherein the at least first, second and third magnetic particles have separate and distinct properties with respect to one another, the properties being selected from the group consisting of magnetic susceptibility, size, mass and a combination thereof;

a buffer port in communication with the inlet end of the elongated hollow channel for injecting a buffer solution into the elongated hollow channel, such that the mixture of the at least first, second and third magnetic particles in the buffer solution flow unencumbered and completely through the elongated hollow channel along the longitudinal direction toward the outlet end thereof, wherein the buffer port comprises first and second branches positioned symmetrically about the mixture port, such that flow of the buffer solution from both of the first and second branches hydraulically focuses flow of the mixture of the at least first, second and third magnetic particles in the buffer solution through the elongated hollow channel;

a magnetic particle separator chamber located at the outlet end of the hollow channel, the magnetic particle separator including:

a first outlet channel disposed at the terminus of the outlet end of the elongated hollow channel;

a second outlet channel disposed adjacent the first outlet channel at the outlet end of the elongated hollow channel;

a third outlet channel disposed adjacent the second outlet channel at the outlet end of the elongated hollow channel, the first, second and third outlet channels being in communication with each other at a junction therebetween within the magnetic separator chamber;

an externally magnetizable wire extending along a transverse axis orthogonal to the longitudinal axis, the externally magnetizable wire being positioned solely contiguous to the first outlet channel; and at least one magnetic source for generating an external magnetic field along a lateral axis substantially orthogonal to both the longitudinal axis and the transverse axis, the external magnetic field generating an induced magnetic field in the externally magnetizable wire, the induced magnetic field applying a repulsive magnetic force to the at least first, second and third magnetic particles, the at least first, second and third magnetic particles being separated to flow into the first, second and third outlet channels due to their separate and distinct properties.

2. The magnetic particle separator as recited in claim 1, wherein said elongated hollow channel is rectangular in cross section.

3. The magnetic particle separator as recited in claim 1, further comprising at least one receptacle for receiving at least one separated volume of the first, second and third magnetic particles.

4. The magnetic particle separator as recited in claim 3, wherein the at least one receptacle comprises a plurality of receptacles, wherein each of the branches of each of the first, second and third outlet channels terminates in a corresponding one of the receptacles.

5. The magnetic particle separator as recited in claim 1, wherein the first, second and third outlet channels are arranged symmetrically about the longitudinal axis.

6. The magnetic particle separator according to claim 1, wherein said externally magnetizable wire is disposed entirely outside said elongated hollow channel and entirely outside said first, second, and third outlet channels, said externally magnetizable wire being positioned to intersect a portion of said longitudinal axis extending outside said channels.

7. A magnetic particle separator, comprising:

an elongated hollow channel extending along a longitudinal axis, the elongated hollow channel having opposed inlet and outlet ends;

a mixture port in communication with the inlet end of the elongated hollow channel for injecting a mixture of first nonmagnetic particles and at least second and third magnetic particles into the elongated hollow channel, wherein the first nonmagnetic particles and the at least second and third magnetic particles have separate and distinct properties with respect to one another, the properties including at least one property selected from the group consisting of magnetic susceptibility, size, and mass;

a buffer port in communication with the inlet end of the elongated hollow channel for injecting a buffer solution into the elongated hollow channel, such that the mixture of the at least first, second and third magnetic particles in the buffer solution flow unencumbered and completely through the elongated hollow channel along the longitudinal direction toward the outlet end thereof, wherein the buffer port includes first and second branches positioned symmetrically about the mixture port, such that flow of the buffer solution from both of the first and second branches hydraulically focuses flow of the mixture of the at least first, second and third magnetic particles in the buffer solution through the elongated hollow channel;

a separating chamber having an inlet port in fluid communication with the outlet end of the elongated hollow channel, the separating chamber having a peripheral wall and at least first, second and third sets of receptacles defined in the peripheral wall, the first set of receptacles being farther from the outlet end of the elongated hollow channel than the second and third sets of receptacles, the third set of receptacles being closest to the outlet end of the elongated hollow channel, the second set of receptacles being between the first and third sets of receptacles, further wherein the separating chamber has an arcuate wall portion and a linear wall portion, the first set of receptacles being defined in the arcuate wall portion and the at least second and third sets of receptacles being defined in the linear wall portion, the first nonmagnetic particles being separated to flow into the first set of receptacles by the semicircular separating chamber and hydrostatic or hydrodynamic forces, the at least second and third particles being separated to flow into the at least second and third sets of receptacles primarily by magnetic repulsion diverting the particles away from the externally magnetizable wire;

an externally magnetizable wire extending along a transverse axis orthogonal to the longitudinal axis, the externally magnetizable wire being positioned outside of and adjacent to the separating chamber and positioned to intersect a portion of said longitudinal axis extending outside the elongated hollow channel and the separating chamber; and at least one magnetic source for generating an external magnetic field along a lateral axis substantially orthogonal to the longitudinal axis and the transverse axis, the external magnetic field inducing a magnetic field in the externally magnetizable wire, the induced magnetic field applying a repulsive magnetic force to the at least second and third magnetic particles, the first nonmagnetic particles being separated to flow into the first set of receptacles and the at least second and third magnetic particles being separated to respectively flow into the second and third sets of receptacles due to their separate and distinct properties.

8. The magnetic particle separator as recited in claim 7, wherein said elongated hollow channel is rectangular in cross-section.

9. The magnetic particle separator as recited in claim 1, wherein said magnetic particle separating chamber is a substantially rectangular and includes an end wall blocking further flow of fluid along the longitudinal axis defined by the elongated hollow channel, the first nonmagnetic particles being separated to flow into the first outlet channel by the end wall of the rectangular separating chamber and hydrostatic or hydrodynamic forces, the at least second and third particles being separated to flow into the at least second and third outlet channels, respectively, primarily by magnetic repulsion diverting the particles away from the externally magnetizable wire.

10. The magnetic particle separator as recited in claim 1, wherein said magnetic particle separating chamber is substantially circular.

11. The magnetic particle separator as recited in claim 1, wherein said separating chamber is symmetric about the longitudinal axis.

12. The magnetic particle separator as recited in claim 1, wherein said mixture port and said buffer port are configured to focus the mixture of first nonmagnetic particles and at least second and third magnetic particles into a wide, thin stream axially centered in the flow of buffer solution through said elongated hollow channel.

13. The magnetic particle separator as recited in claim 1, wherein said separating chamber comprises at least one set of switchable inlets adapted for receiving an auxiliary supply of the buffer solution.

14. A magnetic particle separator, comprising:

an elongated hollow channel extending along a longitudinal axis, the elongated hollow channel having opposed inlet and outlet ends and defining an unencumbered interior expanse;

a mixture port in communication with the inlet end of the elongated hollow channel for injecting a mixture of at least first, second and third magnetic particles into the elongated hollow channel, wherein the at least first, second and third magnetic particles have separate and distinct properties with respect to one another, the properties being selected from the group consisting of magnetic susceptibility, size, mass and a combination thereof;

a buffer port in communication with the inlet end of the elongated hollow channel for injecting a buffer solution into the elongated hollow channel, such that the mixture of the at least first, second and third magnetic particles in the buffer solution flow unencumbered and completely through the elongated hollow channel along the longitudinal direction toward the outlet end thereof, wherein the buffer port comprises first and second branches positioned symmetrically about the mixture port, such that flow of the buffer solution from both of the first and second branches hydraulically focuses flow of the mixture of the at least first, second and third magnetic particles in the buffer solution through the elongated hollow channel;

a first outlet channel disposed at the terminus of the outlet end of the elongated hollow channel a second outlet channel disposed adjacent the first outlet channel at the outlet end of the elongated hollow channel and located further from the terminus of the outlet end;

a third outlet channel disposed adjacent the second outlet channel and located further from the terminus of the outlet end;

a fourth outlet channel disposed adjacent the third outlet channel at the outlet end of the elongated hollow channel and located further from the terminus of the outlet end;

an externally magnetizable wire extending along a transverse axis orthogonal to the longitudinal axis, the externally magnetizable wire being positioned solely contiguous to the first outlet channel; and at least one magnetic source for generating an external magnetic field along a lateral axis substantially orthogonal to both the longitudinal axis and the transverse axis, the external magnetic field generating an induced magnetic field in the externally magnetizable wire, the induced magnetic field applying a repulsive magnetic force to the at least first, second and third magnetic particles, the at least first, second and third magnetic particles being separated to flow into the second, third and fourth outlet channels due to their separate and distinct properties.

15. The magnetic particle separator as recited in claim 14, wherein the injected mixture contains Don-magnetic particles.

16. The magnetic particle separator as recited in claim 15, wherein the non-magnetic particles are separated from the magnetic particles and flow into the first outlet channel.

17. The magnetic particle separator as recited in claim 14, wherein each of the outlet channels are disposed in the same direction as the external magnetic field.

* * * * *